US005647538A

United States Patent [19]

Richardson

[11] Patent Number: 5,647,538

[45] Date of Patent: Jul. 15, 1997

[54] GAS TURBINE ENGINE FUEL INJECTION APPARATUS

[75] Inventor: John S. Richardson, Nottingham, England

[73] Assignee: Rolls Royce plc, London, England

[21] Appl. No.: 358,700

[22] Filed: Dec. 19, 1994

[30] Foreign Application Priority Data

Dec. 23, 1993 [GB] United Kingdom ..... 9326367

[51] Int. Cl.[6] ..... B05B 7/00

[52] U.S. Cl. ..... 239/405; 239/419; 239/423; 239/427

[58] Field of Search ..... 239/406, 405, 239/403, 402, 423, 419, 418, 427, 400; 60/737, 742, 743, 748

[56] References Cited

U.S. PATENT DOCUMENTS 3,912,164 10/1975 Lefebvre et al. ..... 239/406 X 3,917,173 11/1975 Singh ..... 239/406 X

FOREIGN PATENT DOCUMENTS 0478305 4/1992 European Pat. Off. .

2214630 6/1989 United Kingdom .

*Primary Examiner*—Lesley D. Morris

*Attorney, Agent, or Firm*—Cushman Darby & Cushman IP Group Of Pillsbury Madison & Sutro LLP

[57] ABSTRACT

A fuel injection apparatus which is suitable for use with the combustion apparatus of a gas turbine engine, is adapted to produce reduced amounts of noxious emissions. The apparatus comprises a central core which is provided with two fuel supply ducts. The first fuel supply duct supplies fuel for atomization in a swirling airstream; the atomized fuel being subsequently thoroughly mixed with air in an axially elongate mixing duct. The second fuel supply duct supplies fuel to the downstream end of the core where the fuel is atomized by an air flow through a duct surrounding the core before being exhausted from the core downstream end.

14 Claims, 2 Drawing Sheets

GAS TURBINE ENGINE FUEL INJECTION APPARATUS

FIELD OF THE INVENTION

This invention relates to fuel injection apparatus is particularly concerned with fuel injection apparatus which produces reduced amounts of noxious emissions.

BACKGROUND OF THE INVENTION

Fuel injectors, particularly those which are suitable for use in gas turbine engines, are required to operate efficiently over a wide range of conditions while at the same time producing minimal amounts of noxious emissions, particularly those of the oxide of nitrogen. This, unfortunately, presents certain problems in the design of a suitable fuel injector. Thus the characteristics of a given fuel injector under light up and low speed conditions are different to those under full power conditions. Consequently a fuel injector is often a compromise between two designs so that it is able to operate under both of these conditions. This can result in a fuel injector which produces undesirably large amounts of the oxides of nitrogen, at least when it is operating under one set of conditions.

SUMMARY OF THE INVENTION

It is an object of the present invention to provide a fuel injector which is capable of operating under a wide range of conditions while at the same time producing low levels of noxious emissions.

According to the present invention, a fuel injection apparatus for injecting fuel into combustion apparatus comprises a generally annular member having radially inner and outer surfaces terminating at their downstream ends in a common annular lip, means to direct first and second air flows over said first and second surfaces towards said common annular lip, means to direct fuel on to at least one of said radially inner and outer surfaces to form a fuel film which flows in a generally downstream direction over said at least one surface to said common annular lip, whereby said fuel is atomized by said first and second air flows as it flows from said common annular lip, a fuel and air mixing duct outwardly of and extending downstream of said annular member to terminate at the upstream end of the combustion chamber of said combustion apparatus, said mixing duct being of sufficient length to provide thorough mixing of air and said fuel prior to their entry into said combustion chamber for combustion therein, and a generally hollow centerbody located coaxially within said fuel and air mixing duct, the interior of said centerbody being supplied with fuel and air and so arranged as to thoroughly mix said fuel and air supplied thereto and to exhaust said mixture from its downstream end, said centerbody downstream end being positioned in the region of the downstream end of said mixing duct so that in operation said fuel and air mixture is issued therefrom for combustion in said combustion chamber.

BRIEF DESCRIPTION OF THE DRAWINGS

The present invention will now be described, by way of example, with reference to the accompanying drawings in which.

DETAILED DESCRIPTION OF THE INVENTION

Figure 1:
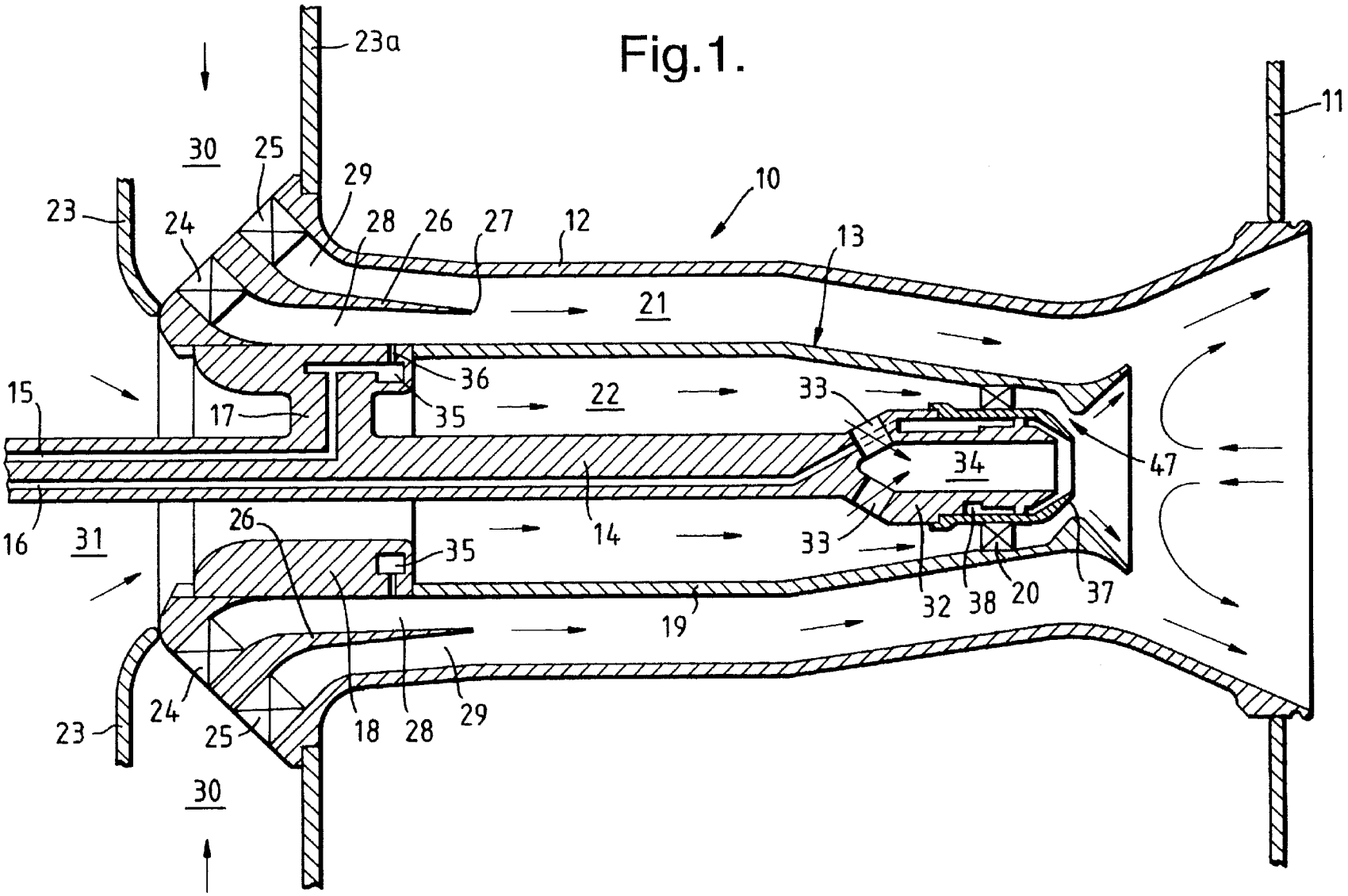
FIG. 1 is a cross-sectional side view of a fuel injection apparatus in accordance with the present invention attached to the upstream end of a combustion chamber.

With reference to FIG. 1, a fuel injection apparatus suitable for a gas turbine engine is generally indicated at 10. The apparatus 10 is attached to the upstream end of a gas turbine engine combustion chamber 11, part of which can be seen in FIG. 1. Throughout this specification, the terms "upstream" and "downstream" are used with respect to the general direction of a flow of liquid and gaseous materials through the fuel injection apparatus 10 and the combustion chamber 11. Thus with regard to the accompanying drawings, the upstream end is towards the left hand side of the drawings and the downstream end is towards the right hand side. The actual configuration of the combustion chamber 11 is conventional and will not, therefore, be described in detail. Suffice to say, however, that the combustion chamber 11 may be of the well known annular type or alternatively of the cannular type so that it is one of an annular array of similar individual combustion chambers or cans. In the case of a cannular combustion chamber, one fuel injection apparatus 10 would normally be provided for each combustion chamber 11. However, in the case of an annular combustion chamber 11, the single chamber would be provided with a plurality of fuel injection apparatus 10 arranged in an annular array at its upstream end. Moreover, more than one such annular array could be provided if so desired. For instance, there could be two coaxial arrays.

The fuel injection apparatus 10 comprises an axisymmetric mixing duct 12 within which a centerbody 13 is coaxially located.

The centerbody 13 in turn comprises a central axially elongate core 14 which contains first and second fuel supply ducts 15 and 16. The upstream end of the core 14 is provided with an integral radially extending strut 17 which interconnects the core 14 with a support ring 18. The strut 17 is also integral with the support ring 18.

The support ring 18 supports the upstream end of a cowl 19 which defines the radially outer surface of the centerbody 13. The downstream end of the cowl 19 is supported by the downstream end of the core 14 by way of a plurality of generally radially extending swirler vanes 20.

A first annular passage 21 is thereby defined between the mixing duct 12 and the cowl 19. Similarly a second annular passage 22 is defined between the cowl 19 and the core 14.

Air under pressure is supplied to an annular region 30 which is upstream of the major portion of the fuel injection apparatus 10. The region 10 is defined by two generally radially extending axially spaced apart walls 23 and **23*a*. The more downstream of the walls, wall 23*a*, additionally supports the upstream end of the fuel injection apparatus 10. The high pressure air is, in operation, supplied by the compressor of the gas turbine engine (not shown) which includes the fuel injection apparatus 10**.

The mixing duct 12 has two annular arrays of swirler vanes 24 and 25 at its upstream end which are separated by an annular divider 26. The annular divider 26 extends downstream of the swirler vanes 24 and 25 to terminate with an annular lip 27. The annular divider 26 thereby divides the upstream end of the annular passage 21 into two coaxial parts 28 and 29 which are of generally equal radial extent.

It will be seen therefore that pressurized air from the region 30 flows over the swirler vanes 24 and 25 to create two coaxial swirling flows of air which are initially divided by the annular divider 26. The two swirling flows of air then combine in the annular passage 21 downstream of the annular lip 27 of the divider The swirler vanes 24 and 25 may be so configured that the two flows of air are either co-swirling or contra-swirling.

A further region 31 which is defined by the wall 23 also contains pressurized air. Air from the region 31 flows through the center of the support ring 18 and into the second annular passage 22. It then proceeds to flow through the annular passage 22 until it reaches the enlarged downstream end 32 of the central core 14. There the air flow is divided. One portion of the air flow passes over the swirl vanes 20 which support the downstream end of the core 14 and is thereby swirled. The swirling air flow is then exhausted from the downstream end of the centerbody 13 whereupon it mixes with air exhausting from the annular passage 21.

The remaining portion of the air flowing through the annular passage 22 flows through holes 33 provided in the core 14 to enter a passage 34 located within the central core downstream end 32. The air flow is subsequently discharged from the downstream end of the passage 34 where it mixes with the swirling air flow exhausting from the swirler vanes 20. The radially inner surface of the downstream end of the centerbody 13 is of convergent-divergent configuration as indicated at 47 in order to promote such mixing.

The first fuel duct 15 directs liquid fuel through the strut 17 to an annular gallery 35 which is situated close to the radially outer surface of the support ring 18. A plurality of radially extending small diameter passages 36 interconnect the annular gallery 35 with the radially outer surface of the support ring 18. The passages 36 permit fuel to flow from the annular gallery 35 into the part 28 of the annular passage 21. There the fuel encounters the swirling flow of air exhausted from the swirler vanes 24. Some of that fuel is evaporated by the air flow and proceeds to flow in a downstream direction through the annular passage 21. The remainder of the fuel, which by this time is in the form of droplets, impinges upon the radially inner surface of the annular divider 26. There it forms a film of liquid fuel which then proceeds to flow in a downstream direction over the radially inner surface of the annular divider 26. Eventually, the fuel film reaches the annular lip 27 at the downstream end of the annular divider 26. There the fuel film encounters the swirling flow of air which has been exhausted from the swirler vanes 25 and flowed over the radially outer surface of the annular divider 26.

It will be appreciated that although fuel described as being directed across the swirling flow of air exhausted from the swirler vanes 24 on to the radially inner surface of the divider 26, this is not in fact essential. For instance fuel could be directed on to the radially inner, or indeed radially outer, surface of the divider 26 through the fuel passages provided within the divider 26.

The adjacent swirling air flows over the radially inner and outer surfaces of the annular divider 26 and atomizes the fuel as it flows off the annular lip 27. The atomized fuel is then quickly evaporated by the air flow exhausted from the swirler vanes 25 before passing into the major portion of the annular space 21. The annular passage 21 is of sufficient length to ensure that the evaporated fuel, and the swirling flows of air which carry it, are thoroughly mixed by the time they reach the downstream end of the duct 12. In order to further enhance the mixing process the duct 12 is of generally convergent-divergent configuration. The divergent outlet of the duct 12 also ensures flame recirculation in the outer region, thereby ensuring in turn the necessary flame stability within the combustion chamber 11.

The thorough mixing of fuel and air in the annular passage 21 ensures that the resultant fuel/air mixture which is subsequently directed into the combustion chamber 11 does not contain significant localized high concentrations of fuel, either in the form of vapor or droplets. This ensures that local areas of high temperature within the combustion chamber 11 are avoided, so in turn minimizing the production of the oxides of nitrogen. Additionally, since no liquid fuel is deposited upon the radially inner surface of the duct 12, liquid fuel cannot flow along that wall and into the combustion chamber 11 to create local areas of high temperature.

The fuel/air mixture exhausted from the annular passage 21 is primarily for use when the gas turbine engine which includes the fuel injection apparatus 10 is operating under full power or high speed cruise conditions. However, under certain other engine operating conditions, primarily engine light-up and low power operations, the fuel/air flow from the annular passage 21 is not ideally suited to efficient engine operation. Under these conditions, fuel is additionally directed through the second fuel supply duct 16.

The second fuel supply duct extends through virtually the whole length of the central core 14. Where it reaches the downstream end 32 of the central core 14, it passes around the holes 33 in the core end 32 to terminate in an annular gallery 38. The annular gallery 38 is defined by the radially outer surface of the core end 32 and an annular cap 37 which fits over the core end 32 in radially spaced apart relationship therewith.

The downstream ends of the core end 32 and the cap 37 are convergent to the same degree so that fuel in the annular gallery 38 is exhausted therefrom in a radially inward direction. The fuel is thus directed as a film into the path of the previously mentioned air flow which is exhausted from the downstream end of the passage 34. This causes atomization of the fuel whereupon the resultant fuel/air mixture mixes with the swirling air flow exhausted from the swirler vanes 20 to cause vaporization of the fuel. The fuel/air mixture then passes into the combustion chamber 11 where combustion takes place.

As in the case of the downstream end of the duct 12, the internal surface of the downstream end of the cowl 19 is divergent at 47 so as to ensure recirculation and hence flame stability.

The fuel supply to the first and second fuel supply ducts 15 and 16 is modulated by conventional means (not shown) so that some or all of the fuel supply to the fuel injection apparatus 10 flows through each of the ducts 15 and 16. Typically therefore under engine starting and low power conditions, all or most of the fuel passes through the second duct 16 to be exhausted from the downstream end of the centerbody 13. However under high power and high speed cruise conditions, all or most of the fuel passes through the first duct 15 to be exhausted into the annular passage 21. There may be circumstances however in which it is desirable to direct fuel through both of the first and second ducts 15 and 16 at the same time, for instance under transitional conditions when the power setting of the gas turbine engine which includes the fuel injection apparatus 10 is changed.

When the fuel supply through either of the first and second fuel supply ducts 15 and 16 is cut off, the air flows through the passages 21 and 22 remain. This is important to ensure that those portions of the fuel injection apparatus 10 which are exposed to the hot combustion process within the combustion chamber 11 are cooled to prevent their damage. It may be desirable, however, to modulate the supply of air to the annular passage 21 in order to achieve efficient combustion. Such air supply modulation could, for instance, be achieved by the use of a mechanism similar to that described in or co-pending UK Patent Application No 9311167.2.

Figure 2:
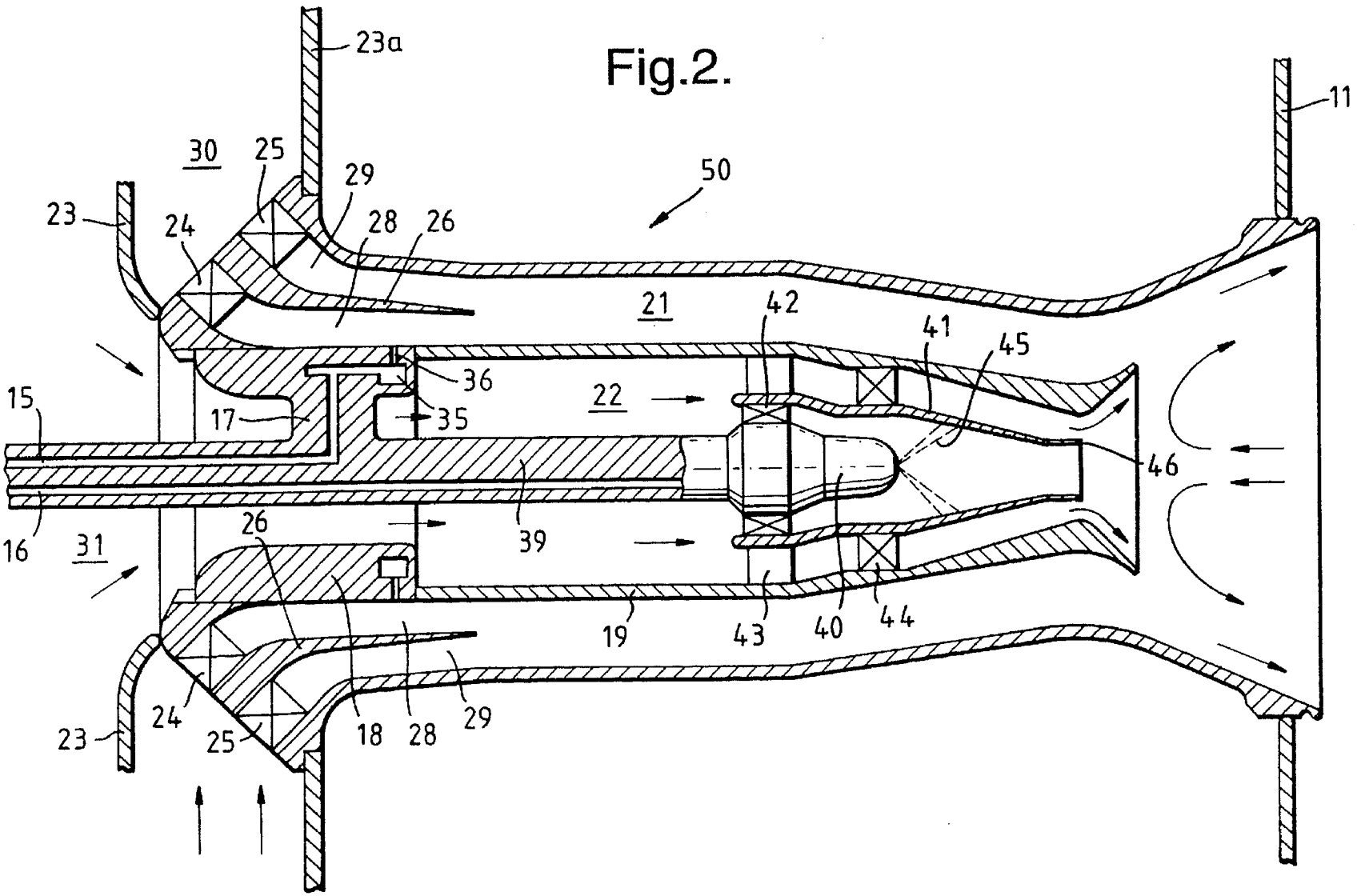
FIG. 2 is an alternative embodiment of the fuel injection apparatus shown in FIG. 1.

An alternative form of fuel injection apparatus 50 in accordance with the present invention is shown in FIG. 2. The majority of the fuel injection apparatus 50 is similar to that 10 which is shown in FIG. 1. Accordingly common features are indicated by common reference numerals.

The fuel injection apparatus 50 differs from the fuel injection apparatus 10 in the downstream configuration of its central core 39. Specifically, the downstream end of the central core 39 incorporates a fuel spray nozzle 40. The fuel spray nozzle 40 is coaxially surrounded by a shroud member 41, the diameter of which generally progressively decreases in the downstream direction. The shroud member 41 is supported at its upstream end from the fuel spray nozzle 40 by an annular array of swirler vanes 42. In addition, the shroud member 41 is supported from the cowling member 19 by struts 43 and further swirler vanes 44.

In operation the fuel injection apparatus 50 functions in a generally similar manner to the fuel injection apparatus 10. Thus air flowing through the annular passage 22 is divided into two portions by the upstream end of the shroud member 41. The first portion flows around the radially outer surface of the shroud member 41 and is swirled by the swirl vanes 44. The second portion flows into the shroud member 41 and is swirled by the swirl vanes 42 before flowing between the fuel spray nozzle 40 and the radially inner surface of the shroud member 41.

Liquid fuel is issued as a conical spray 45 from the fuel spray nozzle 40. The fuel spray 45 thereby passes across the swirling flow of air exhausted from the swirler vanes 42. The swirling air flow vaporizes some of the fuel spray 45 while the remainder impacts the radially inner surface of the shroud member 41. The fuel then proceeds to flow along that radially inner surface in a downstream direction until it reaches an annular lip 46 defined by the downstream end of the shroud member 41. The fuel is launched from the lip 46 and immediately encounters two swirling flows of air: one exhausted from the swirler vanes 42 and the other exhausted from the swirler vanes 44.

These air flows provide vaporization of the fuel before it is exhausted into the combustion chamber 11 and combusted.

It will be appreciated that the interior surface of the cowl 19 and the exterior surface of the shroud member 41 will act as deflecting means to deflect the undiverted portion of the air flow passing through annular passage 22 radially outwardly of the fuel flow and this will facilitate mixing of the fuel with both of the diverted and undiverted portions of the air flow through the centerbody.

I claim:

1. A fuel injection apparatus for injecting fuel into a combustion apparatus including a combustion chamber having an upstream end, said injection apparatus comprising a generally annular member including two adjacent flow passages divided by a surface member located radially interiorly of one of said flow passages and radially outwardly of the other of said flow passages, said surface member terminating in a downstream direction in a common annular lip, means to direct first and second air flows through said flow passages towards said common annular lip, fuel injection means for directing fuel onto at least said surface member to form a fuel film which flows in a generally downstream direction over said surface member to said common annular lip whereby said fuel is atomized by said first and second air flows upon flowing from said common annular lip, a fuel and air mixing duct extending downstream of said surface member to terminate at the upstream end of the combustion chamber of said combustion apparatus, said mixing duct being of sufficient length to provide thorough mixing of air and said fuel prior to their entry into said combustion chamber for combustion therein, and a generally hollow centerbody located coaxially within said fuel and air mixing duct, the interior of said centerbody having fuel supply outlet means for supplying fuel to said centerbody and air being supplied to said centerbody at an upstream end thereof so as to thoroughly mix said fuel and air supplied thereto and to exhaust said mixture from a downstream end thereof, said centerbody downstream end being positioned in the region of the downstream end of the mixing duct and downstream of said annular lip so that in operation said fuel and air mixture is issued from said centerbody downstream end for combustion in the combustion chamber, said mixing duct having an upstream end at said common annular lip with said fuel injection means being located upstream of said common annular lip and adjacent said upstream end of said mixing duct, said fuel supply outlet means of said centerbody being located adjacent said downstream end of said centerbody.

2. A fuel injection apparatus as claimed in claim 1 wherein said fuel injection means to direct fuel on to said at least one surface is so positioned as to direct said fuel across at least one of said first and second air flows prior to fuel reaching said at least one surface.

3. A fuel injection apparatus as claimed in claim 1 wherein swirler vanes are provided to swirl said first and second airflows.

4. A fuel injection apparatus as claimed in claim 3 wherein said swirler vanes are so configured as to swirl first and second air flows in opposite directions.

5. A fuel injection apparatus as claimed in claim 1 wherein said fuel and air mixing duct has a downstream end formed with a radially inner surface and said radially inner surface is formed with a region having a convergent portion and a divergent portion.

6. A fuel injection apparatus as claimed in claim 5 wherein the downstream end of said centerbody is in the region of the convergent portion of the downstream end of said mixing duct.

7. A fuel injection apparatus as claimed in claim 1 wherein said generally hollow centerbody comprises an annular cross section, axially extending cowl coaxially enclosing a central core in radially spaced apart relationship therewith so that together they cooperate to define an annular air flow passage through said centerbody.

8. A fuel injection apparatus as claimed in claim 7 wherein said central core is configured to produce a conical fuel pattern, air flow diverter means being provided to divert a portion of the air which operationally flows through said air flow passage in said centerbody across said conical fuel pattern to provide mixing of said fuel and air.

9. A fuel injection apparatus as claimed in claim 8 wherein another portion of the air is undiverted by said air flow diverter means, and deflector means are provided to deflect said undiverted portion of the air flow through said air flow passage in the direction of said conical fuel pattern and radially outwardly of said fuel flow to facilitate mixing of said fuel with both of said diverted and undiverted portions of said air flow through said centerbody.

10. A fuel injection apparatus as claimed in claim 9 wherein swirler vanes are provided within said hollow centerbody to swirl said undiverted portion of said air flow through said air flow passage.

11. A fuel injection apparatus as claimed in claim 10 wherein swirler vanes are provided to swirl said diverted portion of said air which operationally flows through said air flow passage in said centerbody.

12. A fuel injection apparatus as claimed in claim 1 wherein said central core contains two fuel ducts, the first of said fuel ducts directing fuel to said fuel injection means, the second of said fuel ducts directing fuel to the downstream end of said centerbody for exhaustion therefrom.

13. A fuel injection apparatus for injecting fuel into a combustion apparatus comprising a generally annular member having radially inner and outer surfaces terminating at their downstream ends in a common annular lip, means to direct first and second air flows over said radially inner and outer surfaces toward said common annular lip, fuel injection means to direct fuel onto at least one of said radially inner and outer surfaces to form a fuel film which flows in a generally downstream direction over said at least one surface to said common annular lip whereby said fuel is atomized by said first and second air flows as it flows from said common annular lip, a fuel and air mixing duct extending downstream of said surface member to terminate at the upstream end of the combustion chamber of said combustion apparatus, said mixing duct being of sufficient length to provide thorough mixing of air and said fuel prior to their entry into said combustion chamber for combustion therein, and a generally hollow centerbody located coaxially within said fuel and air mixing duct, the interior of said centerbody being supplied with fuel and air and so arranged as to thoroughly mix said fuel and air supply thereto and to exhaust said mixture from the downstream end thereof, said centerbody downstream end being positioned in the region of the downstream end of said mixing duct so that in operation said fuel and air mixture is issued from said centerbody downstream end for combustion in said combustion chamber, said generally hollow centerbody comprising an annular cross-section, an axially extending cowl coaxially enclosing a central core in radially spaced apart relationship therewith so that together they cooperate to define an annular air flow passage through said centerbody, said central core being configured to produce a conical fuel pattern, air flow diverter means being provided to divert a portion of the air which operationally flows through said air flow passage in said centerbody across said conical fuel pattern to provide mixing of said fuel and air portion, deflector means being provided to deflect the undiverted portion of said air flow through said air flow passage in the same direction as said conical fuel flow and radially outwardly of said fuel flow to facilitate mixing of said fuel with both of said diverted and undiverted portions of said air flow through said centerbody, swirler vanes being provided within said hollow centerbody to swirl said undiverted portion of said air flow through said air flow passage, and other swirler vanes being provided to swirl said diverted portion of said air which operationally flows through said air flow passage in said centerbody, said downstream end of said centerbody being provided with a secondary annular axially extending shroud member, said secondary annular shroud member being positioned so that conical fuel flow is directed onto the radially inner surface of said secondary annular shroud member across said diverted portion of said air flow.

14. A fuel injection apparatus as claimed in claim 13 wherein the undiverted portion of said air flow flows over the radially outer surface of said secondary annular shroud member.

* * * * *